US008658062B2

(12) United States Patent
Kumta et al.

(10) Patent No.: US 8,658,062 B2
(45) Date of Patent: Feb. 25, 2014

(54) NANOSCALE SILICON-BASED COMPOSITIONS AND METHODS OF PREPARATION

(75) Inventors: Prashant N. Kumta, Pittsburgh, PA (US); Moni Kanchan Datta, Pittsburgh, PA (US)

(73) Assignee: University of Pittsburgh—Of the Commonwealth System of Higher Education, Pittsburgh, PA (US)

( * ) Notice: Subject to any disclaimer, the term of this patent is extended or adjusted under 35 U.S.C. 154(b) by 736 days.

(21) Appl. No.: 12/564,571

(22) Filed: Sep. 22, 2009

(65) Prior Publication Data

US 2010/0078599 A1 Apr. 1, 2010

Related U.S. Application Data

(60) Provisional application No. 61/100,368, filed on Sep. 26, 2008.

(51) Int. Cl.
*H01B 1/04* (2006.01)

(52) U.S. Cl.
USPC ..... 252/502; 252/182.1; 252/500; 429/163; 429/218.1; 429/220; 429/231.8

(58) Field of Classification Search
USPC ..... 252/500, 182.1, 502; 429/218.1, 163, 429/220, 231.8
See application file for complete search history.

(56) References Cited

U.S. PATENT DOCUMENTS

| | | | | |
|---|---|---|---|---|
| 4,465,745 | A * | 8/1984 | Akridge | 429/322 |
| 2004/0137327 | A1* | 7/2004 | Gross et al. | 429/231.8 |
| 2006/0275668 | A1 | 12/2006 | Peres et al. | |
| 2007/0190413 | A1* | 8/2007 | Lee et al. | 429/218.1 |
| 2008/0003502 | A1 | 1/2008 | Jumas et al. | |
| 2009/0023065 | A1* | 1/2009 | Hwang et al. | 429/220 |

OTHER PUBLICATIONS

Sandu et al., Synthesis of Nanosized Si Particles via a Mechanochemical Solid?Liquid Reaction and Application in Li-ion Batters. Solid State Ionics, Jul. 31, 2007, Vo. 178, No. 21-22, pp. 1297-1303 (abstract) [online], [retrieved on Nov. 15, 2009]. Retrieved from the Internet: URL: http://www.sciencedirect.com.

Datta, et al. "Silicon, Graphite and Resin Based Hard Carbon Nanocomposite Anodes for Lithium Ion Batters." Journal of Power Sources, Feb. 25, 2007, vol. 165, pp. 368-378, (abstract) [online], [retrieved on Nov. 14, 2009]. Retrieved from the internet, URL: http://www.sciencedirect.com.

Wang et al. "Reversibile High Capacity Nanocomposite Anodes of Si/C/SWNTs for Rechargeable Li-Ion Batteries." The Electrochemical Society, 212th ESC Meeting, 2007, Abstract No. 706, (abstract) [online], [retrieved on Nov. 14, 2009]. Retrieved from the Internet: URL: http://scitation.aip.org.

* cited by examiner

*Primary Examiner* — Khanh Tuan Nguyen
(74) *Attorney, Agent, or Firm* — Robert Seamans Cherin & Mellott, LLC; Carol A. Marmo

(57) ABSTRACT

The present invention is related to nano-particle compositions, methods of their preparation and applications thereof. The nano-particle compositions include silicon-containing nano-particles, a graphite matrix, carbon nanotubes and an amorphous carbon interface formed between the silicon-containing nano-particles and the graphite matrix.

4 Claims, No Drawings

NANOSCALE SILICON-BASED COMPOSITIONS AND METHODS OF PREPARATION

CROSS-REFERENCE TO RELATED APPLICATION

The present application is a traditional application of U.S. Provisional Patent Application Ser. No. 61/100,368, filed Sep. 26, 2008, and entitled, "Nanoscale Silicon-Based Compositions and Methods of Preparation," which is herein incorporated by reference in its entirety.

FIELD OF THE INVENTION

The present invention relates to compositions including silicon-containing nano-particles, methods of their preparation and applications thereof, including the use of said nano-particle compositions in dispersions, electrodes, and capacitors.

BACKGROUND OF THE INVENTION

Nanotechnology is an increasingly employed concept in the development and progression of a wide variety of technologies, including the field of electrochemistry. Nano-size materials have been investigated and discovered for use as anode materials in energy storage and conversion devices such as electrodes and capacitors. Currently, carbon is a preferred material for use in anodes. Carbon is an inexpensive anode material, however, there are disadvantages associated with the use of carbon. For example, the volumetric power density of carbon is not sufficiently high. Metal, metal alloy and metal oxide nano-composites have been identified as potential alternative anode materials to carbon. It is believed that the discharge capacities of these nano-composites may exceed the known discharge capacities of carbon. Metals can be good electronic conductors and offer the potential to exhibit high gravimetric and volumetric capacitance due to their large molar densities. Metal alloys can be formed at room temperature, for example, if a metal is polarized to a sufficiently negative potential in a Li-ion conducting electrolyte. It is believed that the charge density of some metal alloys may be higher than that of lithiated carbon. However, the potential advantages of these materials have not resulted in their commercial use and carbon remains a preferred anode material. It is believed that the limited progress of metals, metal alloys and metal oxides as alternative anode materials may be due to metals undergoing major changes in structure and volume while alloying. For example, in the formation of $Li_x^+M^{x-}$, the host metal (M) not only accepts several moles of Li per metal but also accommodates negative charges. This process can result in the formation of a brittle alloy. Further, the resultant brittle alloy can undergo a significant volume change (e.g., from 300-600%) between the unalloyed and alloyed states. This change can build mechanical stresses which can result in crumbling and loss of inter-particle electronic contact that may cause capacity loss and fade which may lead to rapid failure of cells.

It is desirable to develop a process for synthesizing nano-particles including metals, such as Si, contained in a nano-structured matrix. It is believed that an active material in an inactive matrix can result in a large capacity as well as the desired reversibility enabling superior performance as compared to carbon as an anode material. Furthermore, it is believed that the presence of carbon nanotubes can contribute to improved performance. The compliant nature of carbon nanotubes and their ability to bend and flex can result in the nanotube maintaining electrical contact with the active material during alloying and de-alloying and thus, preserving the desirable high gravimetric capacity of the active material.

Thus, it is desired to formulate strategies to identify approaches and systems that can demonstrate reversible and stable high capacities while exhibiting other characteristics such as irreversible loss and electrochemical stability.

SUMMARY OF THE INVENTION

In one aspect, the present invention provides a nano-particle composition including amorphous and/or nanocrystalline silicon-containing nano-particles, a graphite matrix and an amorphous carbon interface formed between the amorphous and/or nanocrystalline silicon-containing nano-particles and the graphite matrix.

In another aspect, the present invention provides a method of preparing an amorphous and/or nanocrystalline silicon-containing nano-particle in situ, comprising reacting a silicon-containing material and a reducing agent.

In another aspect, the present invention provides a method of preparing a nano-particle structure in situ including combining amorphous and/or nanocrystalline silicon-containing nano-particles and graphite to produce a mixture, milling the mixture to produce a milled precursor, and heat treating the milled precursor to produce the nano-particle structure.

In yet another aspect, the present invention provides a nano-particle-containing dispersion including amorphous and/or nanocrystalline silicon-containing nano-particles, a graphite matrix, and carbon nanotubes, wherein an amorphous carbon interface is formed between the amorphous and/or nanocrystalline silicon particles and the graphite matrix.

In still another aspect, the present invention provides a method of preparing a nano-particle-containing dispersion including combining amorphous and/or nanocrystalline silicon-containing nano-particles and graphite to produce a mixture, milling the mixture to produce a milled precursor, heat treating said milled precursor to produce a nano-composite, and mixing carbon nanotubes with the nano-composite.

The present invention also provides for an electrode and a capacitor including the nano-particle composition above-described.

DETAILED DESCRIPTION OF THE INVENTION

The present invention relates to nano-particle compositions which include amorphous and/or nanocrystalline silicon-containing nano-particles, a graphite matrix and an amorphous carbon interface formed between the silicon-containing nano-particles and the graphite matrix. The nano-particle compositions can include nano-composites and nano-scale hetero-structures.

The silicon-containing nano-particles for use in the present invention can include a wide variety of silicon and/or silicon-containing materials known in the art. For example, the silicon-containing nano-particles can include but are not limited to silicon monoxide (SiO), silicon disulfide ($SiS_2$), silicon diselenide ($SiSe_2$), silicon ditelluride ($SiTe_2$), silicon tetraiodide ($SiI_4$), and mixtures thereof. The silicon and/or silicon-containing material can be in a variety of forms, such as but not limited to, a powder. In one embodiment, the silicon-containing material is silicon monoxide powder.

The graphite matrix for use in the present invention can include a wide variety of graphite and/or graphite-containing materials known in the art. For example, the graphite matrix can include but is not limited to graphite, graphitic carbon and mixtures thereof.

The amorphous and/or nanocrystalline silicon-containing nano-particles can be prepared by various methods. In an aspect of the present invention, the silicon-containing nano-particles are prepared in situ by high energy mechanical milling (HEMM) and/or high energy mechanochemical milling (HEMC). For example, the silicon-containing material and a reducing agent are charged to the mill. The reducing agent can be selected from a wide variety of compounds known in the art. Suitable reducing agents can include but are not limited to boron, carbon, lithium, calcium, magnesium, sodium, potassium, phosphorus, arsenic and mixtures thereof. Further, stainless steel (SS) balls are included in the charge with the precursor materials. The SS balls typically used in a HEMM or HEMC process have a diameter in the range of from 5 mm to 8 mm. The silicon-containing material, SS balls and reducing agent can be weighed prior to being charged. The amount of each of the charge components can vary. In alternate embodiments, the charge ratio of the balls to the silicon-containing material (e.g., powder) can be 20:1 or 10:1 or 8:1 or 5:1. Different charge ratios can cause variations in the kinetics of the mechanochemical reduction.

In one embodiment, Si-containing nano-particles are prepared using an in situ mechanochemical reduction method wherein the strong affinity of boron (B) for oxygen (O) and the relative thermodynamic instability of silicon monoxide (SiO) is considered in mechanochemically reducing SiO to form nanostructured and/or amorphous Si. The mechanochemical reduction reaction is represented as follows:

$$3SiO+2B \rightarrow 3Si(\text{nanocrystalline})+B_2O_3 \quad (I)$$

The mechanochemical reduction reaction is conducted by milling. The SiO precursor, stainless steel balls and elemental B form the charge. The SiO precursor can be in various forms for milling. In an embodiment, the SiO is in the form of a powder. In one embodiment, as shown in Eqn. (I), in one embodiment, the stoichiometric ratio of SiO and B is 3:2. The result of the milling of the charge is the in situ formation of unagglomerated nano-sized Si clusters and born oxide ($B_2O_3$).

The in situ formed nanocrystalline and/or amorphous Si then can be milled with graphite to produce a dispersion of nanoscale clusters of Si embedded in a graphite matrix. The graphite can be present in an amount of from 50 to 80 percent by weight of the composition. Without intending to be bound by any particular theory, it is believed that when silicon (Si) alloys with lithium (Li) there is volumetric stress which occurs as a result. The presence of the graphite matrix contributes to relieving this stress.

A polymeric precursor may be optionally used in the milling process. The polymeric precursor can act as a diffusion barrier during milling resulting in the formation of a homogeneous dispersion of Si and graphitic carbon (C) and minimizing or precluding the reaction of Si and C to form inactive silicon carbide (SiC). The polymeric precursor can be selected from a wide variety of polymers known in the art and can include, but is not limited to, polyacrylonitrile (PAN), polymethacrylonitrile (PMAN), cellulose, purolite and mixtures thereof. In an embodiment, the polymer can be dissolved in a solvent. The solvent can be selected from a wide variety known in the art. In one embodiment, the solvent is N-methyl pyrrolidinone (NMP). The amount of polymer can vary. In one embodiment, the amount of polymer in the charge is in excess as compared to the amount of each of the nanocrystalline Si and the graphite used.

The Si nanoclusters with boron oxide, graphite, SS balls and optionally polymeric precursor can form the charge to the milling machine. The amount of each of the charge components can vary. Further, the duration of the milling also can vary depending on the amount of time needed to produce a homogeneous mixture. In one embodiment, the milling can be conducted for up to 8 hours. In another embodiment, the mixture can milled for a period of up to 15 hours. Upon completion of the milling, a homogeneous mixture or slurry of nanosized Si, boron oxide and graphitic carbon is formed.

The milled material is then dried in a vacuum oven to evaporate the solvent (e.g., NMP) and yield homogeneously dispersed nano-sized Si with boron oxide and carbon covered with a thin film of polymer. In one embodiment, the yield is essentially free of SiC.

The resultant dried material is then heat treated to produce nanoscale clusters of Si in a graphitized matrix with non-graphitic amorphous carbon forming a thin interface layer. The exposure of the dried material to heat contributes to eliminating and decomposing the polymer to form the thin film of carbon. Non-graphitized hard carbons can be prone to large irreversible losses. Thus, treatment approaches, such as pyrolysis, can be used to lower the irreversible loss. Treatment approaches can also result in good electrical conductivity (e.g., from 2 to $5\times10^4\ \Omega^{-1}\ cm^{-1}$) and good mechanical strength, resulting in desirable inactive matrices. Further, these nanocomposites can exhibit stable capacities in the range of from 650 to 700 mAh/g. Without intending to be bound by any particular theory, it is believed that the active graphite matrix provides good Li-ion transport and allows the active phase to be incorporated into the nanocomposite while the amorphous carbon derived from the pyrolysis of the polymer forms a strong interface between the nano-scale Si clusters and the graphite matrix.

The temperature at which the heat treatment is conducted can vary and can include any temperature that is typically used. In one embodiment, the temperature is at least 500° C. or no greater than 1000° C. or in the range of from 500° C. to 800° C. Further, the heat treatment can be carried out in an argon (Ar) atmosphere, such as but not limited to, an ultra high purity argon (UHP Ar) atmosphere. The flow rate of the argon can vary widely and can include any flow rate that is typically used. In one embodiment, the ultra high purity argon is supplied at a flow rate of approximately 100 cc/min. It is believed that heat treatment in an argon atmosphere further contributes to elimination and decomposition of the polymer to form a thin film of amorphous or disordered carbon over the Si and C. The formation of this thin film can contribute to creating a strong interface between the Si and C. Similarly, there may be a strong interface created between the Si, C and boron oxide. Without intending to be bound by any particular theory, it is believed that a well-integrated nanocomposite may substantially preclude or minimize the likelihood of the silicon undergoing rapid expansion and contraction; thus, enabling the structure to be preserved without eliciting cracking or crumbling of the electrode which can occur in bulk silicon structures.

The milling can be conducted in dry or wet conditions. In wet conditions, inert solvents can be used to lower an internal rise in temperature inhibiting the kinetics while also causing agglomeration of the primary nano-sized crystallites. Suitable inert solvents can be selected from the wide variety known in the art, such as, for example, but not limited to, toluene, xylene, NMP, acetonitrile and mixtures thereof. In an embodiment, the elemental oxide (e.g., boron oxide) formed during milling of the Si-containing material (e.g., SiO) and the reducing agent (e.g., B) can be removed by a leaching process. Any conventional leaching process can be employed. In one embodiment, the leaching process can include the use of anhydrous methanol, ethanol or mixtures thereof. Alternatively, the oxide can be allowed to remain in the composite allowing for possible lithium-ion conduction and thereby minimizing the solid electrolyte interphase (SEI) related irreversible loss.

In an aspect of the present invention, the HEMM and/or HEMC derived Si/C material can be used as precursor to form a dispersion. The Si/C precursor is combined with a carbon-containing nano-particle material, such as but not limited to, carbon nanotubes (CNTs). The carbon nanotubes can include single walled nanotubes, multi-walled nanotubes and mixtures thereof. The carbon nanotubes can be prepared by any mechanism known in the art. For example, the carbon nanotubes can be prepared by conventional chemical vapor deposition methods or any other thin film and electric discharge methods. The amount of Si/C precursor and carbon-containing nano-particle material can vary. In one embodiment, the carbon nanotubes can be present in an amount ranging from 1 to 40% by weight of the mixture. In another embodiment, the Si:C can be present in a ratio of from 1:1 to 1:2.

The dispersion can optionally include a non-aqueous solvent selected from those known in the art. Suitable non-aqueous solvents can include but are not limited to inert aprotic hydrocarbons, such as, toluene, xylene, NMP, acetonitrile and mixtures thereof. The ratio of nano-particles to solvent can be from 10 v/v to 100 v/v.

The Si/C and carbon-containing nano-particle dispersion can be mixed using a method such as sonication or ultrasonication. Low energy mixing minimizes or precludes degradation of the nanotube architecture. In one embodiment, the Si/C nanoparticles and optionally solvent can be homogenized using a sonicator; and the carbon-containing nano-particle material (e.g., nanotubes) can be admixed into the homogenized dispersion. The sonication can be conducted at low energy. For example, the sonication can be conducted in a range of from 10 to 60 watts or 20 to 30 watts or at approximately 20 watts, to produce a substantially uniform dispersion. The resultant dispersion can be dried using conventional drying techniques known in the art to remove the solvent. The resultant mixture (e.g., Si/C/CNT containing PAN) then can be pyrolyzed at suitable temperatures, such as in the range of from 500° C. to 1000° C. in an ultrahigh purity argon (UHP-Ar) atmosphere to generate a nano-particle composition. Without intending to be bound by any particular theory, it is believed that the CNTs can contribute to the mechanical integrity and the desired electronic conductivity enabling the nano-composite to exhibit high capacities such as at least 1000 mAh/g.

In another embodiment, Si/C/CNT heterostructures can be produced directly by mechanochemically reducing silicon-containing material (e.g., SiO) with a reducing agent (e.g., B) in the presence of graphite and polymer (e.g., PAN). The resultant mixture after milling then can be mixed with CNTs in accordance with the sonication/ultrasonication process described above. The elemental oxide (e.g., boron oxide) formed can be leached.

The Si/C nano-particles or dispersion containing said nano-particles can be used to produce an electrode. The electrode can be prepared using a variety of known methods. For example, the nano-particle material can be deposited or formed on an electrically conductive support, such as a metal foil, mesh or the like. In an embodiment, the support is copper foil; in another embodiment, the support is nickel mesh. The nano-particle material can be directly deposited on the support as a thin film or formed as a layer. The thin film or layer can be deposited or formed by using conventional techniques known in the art, such as but not limited to, dip coating or spray deposition or slurry coating. The nano-particle material coating then can be dried at an appropriate temperature to form the electrode. The drying temperature and time can vary and can be dependent upon the composition employed and the thickness of the thin film or layer. The thickness of the nano-particle coating can vary. In one embodiment, the thickness can range from 5 to 10 Angstroms. Furthermore, the electrode can have a surface area of from 50 to 300 $m^2/g$.

In addition to the nano-particle material of the present invention, the electrode can include other conventional materials, such as carbon and binder. Suitable binders can be selected from a variety known materials. In one embodiment, the binder includes, but is not limited to, poly-vinylidene fluoride (PVDF), carboxy methyl cellulose (CMC), poly-a-hydroxy esters such as poly-glycolic acid (PGA), poly-lactic acid (PLA), poly-caprolactone (PCL) and poly-lactic-co-glycolic acid (PLGA), and mixtures thereof.

The use of poly-a-hydroxy esters as binder material can exhibit a combination of good mechanical strength and toughness properties. As a result, the electrode formulations can retain the large capacity characteristic of the system without causing decripitation and/or loss of contact between the active materials. Further, these polymers are soluble in non-aqueous aprotic solvents such as tetrahydrofuran (THF), chloroform, dichloromethane and mixtures thereof.

In one embodiment, the Si/C/CNT dispersions produced in accordance with the description provided herein above is mixed with poly hydroxyl ester polymer such as PCL, PLA or PLGA which is dissolved in chloroform, tetrahydrofuran (THF) or methylene chloride. The Si/C/CNT dispersion generated by mechanochemical milling includes up to 85 wt % of the mixture. The inactive elemental oxide (e.g., boron oxide) generated is mixed with up to 8 wt % binder and up to 7 wt % super P carbon or acetylene black acting as an electronic conductor. The wt % binder includes the PCL, PLA or PLGA polymer dissolved in chloroform, THF or methylene choride to form a slurry. In alternate embodiments, the ratios can vary. For example, the dispersion can include up to 85 wt % Si/C/CNT, up to 10 wt % conducting carbon, such as super P or acetylene black, and from 5 to 10 wt % of binder. The mixture is mixed with solvent (e.g., 1-2 ml) to form a slurry that will be coated onto electrode foils, e.g., electrodeposited copper foils. After coating, the electrode foils are dried in vacuum at a temperature of approximately 120° C. for a time period of approximately 12 hours to evaporate the THF or methylene choride or chloroform. The dried electrodes then can be subjected to the peel test for mechanical integrity. Alternatively, the electrodes can be subjected to tensile tests in an Instron test machine using appropriate loads and strain rates.

A stress-strain tester can be used to measure the mechanical properties of the polymers. For example, the strain rate for dry films will be maintained at $\pm 0.01\ min^{-1}$ to mimic the expansion and contraction rates of alloy based electrodes in typical charge/discharge cycles. The strain rate in the non-aqueous solvent will be increased to $\pm 0.05\ min^{-1}$ to decrease the effect of the solvent evaporation such as DEC. Special modification can be made to the sample grips to demonstrate the properties of the binder films immersed in the liquid solvent. The solvent used can be a mixture of EC (ethylene carbonate) and DEC (Diethyl carbonate) having a ratio of 1:2 by volume. The sample can be mounted in the grips, the container with the liquid solvent can be lifted and the sample film can be immersed in the solvent for approximately 5 minutes prior to initiating the measurement. Electrochemical reactions such as the decomposition of the solvent, can potentially occur if the difference between the grips is too high.

The synthesized materials also can be characterized for crystal structure, microstructure, and electrochemical response. The crystal structure can be evaluated using XRD conducted on pre-sieved (−325 mesh) powders. Rietveld refinement can also be conducted using RIETAN to simulate experimentally obtained patterns and ascertain the symmetry and space group. HRSEM and HRTEM can be conducted primarily to characterize the morphology and the crystallite size of the nano-scale components. EDAX can be used to identify the composition of the phases. The structure and phase evolution in the as-prepared and heat-treated powders can be analyzed using XRD, HRSEM/HRTEM, and FTIR techniques. These studies can contribute to determining the transformation mechanisms leading to the formation of the amorphous carbon phases and the presence of any interface phases. XRD, FTIR, HRSEM and HRTEM combined with EDAX and EELS also can be conducted on the synthesized nano-composite structures to determine the chemical composition, distribution of the individual species, crystallinity of the various phases and presence of any interface reactions, including the presence and evolution of SEI phases.

A combination of potentiostatic, galvanostatic, and cyclic voltammery techniques can be used to test the electrochemical capacity of synthesized nanocomposites. Specifically, the cells fabricated can be tested to investigate three different aspects: (a) the differential capacity (dx/dV, where 'x' is concentration of mobile Li species) as a function of the voltage (V) generated at constant current; (b) the variation in electrochemical efficiency as a function of the applied current input; and (c) the charge and discharge reactions employing linear sweep (LSV) and cyclic voltammetry. These measurements can be conducted using a three-electrode hockey-puck cell design following known procedures. For example, a homogeneous slurry containing 80 wt % of the active material, 15 wt % acetylene black and 5 wt % PVDF can be prepared. The polyvinylidene fluoride can be dissolved in n-methyl pyrrolidinone (NMP) as solvent. The binder can be selected from PCL, PLA and PLGA in solvent selected from THF and methylene chloride. The slurry can be coated onto electrodeposited copper foils. After coating, each electrode can be punched into a disk (1 $cm^2$ in area) and then dried in vacuum at 120° C. for 12 hours. The cells then can be tested employing Li foil as a counter electrode utilizing 1M $LiPF_6$ in EC and DMC (having a ratio of 2:1) as the electrolyte. Cells can be assembled in an Ar-filled glove box (from Vacuum Atmospheres) with oxygen and moisture levels less than 1 ppm. The electrochemical analysis can be conducted using an Arbin potentiostat (from Arbin Instruments). The current densities for constant current tests can be set at 0.25 $mA/cm^2$ and the operating voltage can be adjusted between 0.02V and 1.2V. Various current rates can be used. The actual voltage limits depend on the materials employed. Linear sweep voltammetry tests also can be conducted using different sweep rates ranging from 4 μV/s to 10 mV/s. The different sweep rates can be employed to distinguish the reactions occurring during charge and discharge. This can contribute to determining the electrochemical activity of the synthesized material and also ascertain the voltage range for the constant current tests. These tests can also contribute to understanding any irreversible losses in the materials. Systematic structural and micro-structural analyses can be conducted on the charged and discharged materials. Varying rates also can be implemented as mentioned above to test the rate capability of these systems. For example, C-rates C/2, 1C and 2C can be used.

The above mentioned electrochemical characterization tests can be conducted on synthesized anode structures including the nano-particle compositions of the present invention. Constant current cycling and rate capability tests can be conducted using full cell configurations employing standard cathodes such as $LiCoO_2$. In addition, tests can be conducted using half cell configuration involving three electrodes as mentioned above wherein the third reference electrode can be pure Li metal. Identical tests can be conducted in both half cell and full cell configurations with the exception that the anode can include the synthesized nano-composite anode materials exhibiting an improved electrochemical response. Further, in full cell configurations the materials provided by Li ion cells can be used as the cathodes.

AC impedance analyses also can be conducted on the prototype half-cells as well as the nano-particle compositions of the present invention. The composition can be in the form of a powder which can be pressed at a pressure of 20 MPa onto copper-grids (e.g., ca. 20 $mg/cm^2$). Impedance studies on the half cells can be performed potentiostatically, measured by applying 5 mV amplitude over a frequency range of from 5 mHz to 10 kHz at different stages of charge and discharge. Sufficient time can be allowed for equilibration of the sample after charge or discharge. The impedance studies can include a comparison of the low frequency and high frequency responses of the electrode to ascertain charge transfer at the electrode-electrolyte interface and potential Warburg factors indicative of variation in relaxation time and diffusion limitations due to grain boundary, defects and passivation. This information can be useful to ascertain the kinetic factors of the electrode and the mechanism, combined with the rate of transport of lithium. Impedance and galvanostatic cycling tests can be conducted on as prepared and heat treated nano-particle materials to identify the role of microstructure on the transport and diffusion of Li. Impedance studies also can be conducted on cycled samples to elucidate the mechanisms for capacity loss during cycling. In addition, impedance analysis and galvanostatic tests can be conducted on nano-particle materials which are heat treated to systematically coarsen the microstructure to analyze the influence of grain size and grain boundary on the transport of Li.

It is believed that the initial formation of the lithiated alloy may affect the subsequent cycling of the electrode. Therefore, conditions of the first cycle lithiation can be varied from very low continuous current, (~0.05 $mA/cm^2$), to a pulse charging regime with a low duty cycle, e.g. 10%. Electrochemical evaluations can be conducted on samples prepared accordingly. XRD, HRSEM/HRTEM analyses can be conducted to assess the structural and micro-structural changes occurring during cycling.

The following reactions potentially occur during the reversible Li transport:

1. Formation of a passivation layer at the interface of the high surface area nano-crystalline inactive matrix and the active species, and the electrolyte;
2. Possible entrapment of the active phase within the inactive matrix preventing diffusion of $Li^+$ increasing the charge-transfer resistance;
3. Grain size of the active phase exceeding the critical size required for cycling;
4. Hysteresis of micro-cracking of the active phase resulting in breakdown of the active-inactive interface; and
5. Growth and clustering of the active species forming large islands leading to loss in capacity retention.

Examples

Synthesis of Nanocrystalline and/or Amorphous Si by Mechanochemical Reduction of SiO or $SiS_2$ Using B as Reducing Agent Mixtures of SiO and amorphous B powders in a molar ratio of 3:2 were subjected to high energy mechanical milling in a high energy shaker mill (SPEX CertiPrep) up to 10 hours in a stainless steel (SS) vial using 20 SS balls of 2 mm diameter (approximately 20 g) with a ball to powder ratio of 10:1. Approximately 0.1.72 g SiO and approximately 0.28 g amorphous B powder were batched in a SS vial inside an argon filled glove box in order to prevent oxidation of the reactive components during milling. In another experiment, SiO and graphite (C) powder was used to synthesize nanocrystalline Si by mechanochemical reduction of SiO and C in the ratio of 1:1 using high energy mechanical milling.

Mixtures of $SiS_2$ powder and amorphous B powder in a molar ratio of 3:4 were subjected to mechanical milling up to 6 hours in a SS vial using 20 SS balls of 2 mm diameter (approximately 20 g) with a ball to powder ratio of 10:1. Approximately 1.62 g $SiS_2$ and approximately 0.38 g amorphous B powder were batched in a SS vial inside an argon filled glove box in order to prevent oxidation of the reactive components during milling.

Formation of nanocrystalline Si (nc-Si) and amorphous Si (a-Si) were generated by reduction of SiO or $SiS_2$ using B and C powder after 10 hours and 6 hours of milling, respectively, and confirmed by X-ray diffraction analysis and HRTEM. The XRD patterns of SiO and C milled for 10 hours, clearly showed the formation of nanocrystalline Si. Formation of amorphous Si was identified during SiO reduction by B.

To evaluate the electrochemical characteristics, electrodes were fabricated by mixing 82 wt % of the active powder and 8 wt % Super P carbon. A solution containing 10 wt % PVDF in NMP was added to the mixture. The as-prepared slurry was coated onto a Cu foil. A three electrode hockey-puck cell was used employing Li foil as counter and reference electrode and 1M $LiPF_6$ in EC:DEC as the electrolyte. The cell was tested in the voltage range of from 0.02V-1.2V employing a constant current of 160 mA/g.

The variation of specific capacity versus cycle number for the first few cycles of nc-Si/$B_2O_3$ cycled at a constant current of approximately 160 mA/g. There was a first discharge and first charge capacity of approximately 1622 mAh/g and approximately 923 mAh/g, respectively, with a irreversible loss of 50%. Large irreversible loss arises due to the irreversible reaction of lithium with boron oxide. Nanocrystalline Si synthesized by mechanochemical reduction of SiO with C showed a first discharge capacity of approximately 1440 mAh/g and a first charge capacity of approximately 730 mAh/g.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and no limiting as to the scope of the invention, which is to be given the full breadth of the claims appended hereto and any and all equivalents thereof.

The invention claimed is:

1. A method of preparing a nano-particle structure in situ, comprising:

combining a silicon-containing material and a reducing agent to form a first mixture;

milling the first mixture to form in situ amorphous and/or nanocrystalline silicon-containing nano-particles;

combining the amorphous and/or nanocrystalline silicon-containing nano-particles with polymer and graphite to produce a second mixture;

milling said second mixture to produce a milled precursor; and heat treating said milled precursor to produce said nano-particle structure.

2. The method of claim 1, wherein said polymer is selected from the group consisting of polyacrylonitrile, polymethacrylonitrile, cellulose, purolite and mixtures thereof.

3. The method of claim 1, wherein silicon carbide formation is minimized at least, or precluded.

4. The method of claim 1, wherein the polymer is present in an amount that is in excess as compared to an amount of each of the amorphous and/or nanocrystalline silicon-containing nano-particles and the graphite in the mixture.

* * * * *

UNITED STATES PATENT AND TRADEMARK OFFICE

CERTIFICATE OF CORRECTION

PATENT NO. : 8,658,062 B2
APPLICATION NO. : 12/564571
DATED : February 25, 2014
INVENTOR(S) : Prashant N. Kumta et al.

It is certified that error appears in the above-identified patent and that said Letters Patent is hereby corrected as shown below:

On the Title Page
Second column, item (56) OTHER PUBLICATIONS, line 2, "Solid?Liquid" should read --Solid-Liquid--.
Second column, item (56) OTHER PUBLICATIONS, line 3, "batters" should read --batteries--.
Second column, item (56) OTHER PUBLICATIONS, line 7, "batters" should read --batteries--.
Second column, item (56) OTHER PUBLICATIONS, line 11, "Reversibile" should read --Reversible--.
Second column, item (74) *Attorney, Agent, or Firm,* "Robert" should read --Eckert--.

In the Specification
Column 3, line 38, "In one embodiment, as shown" should read --As shown--.
Column 3, line 41, "born" should read --boron--.
Column 3, line 66, "nanoc-" should read --nano--.
Column 3, line 67, "rystalline" should read --crystalline--.
Column 4, line 8, "can milled" should read --can be milled--.
Column 6, line 15, "variety known" should read --variety of known--.
Column 10, line 1, "160 mA/g." should read --160 mAh/g.--.
Column 10, line 15, "no limiting" should read --not limiting--.

Signed and Sealed this
Twenty-fourth Day of June, 2014

Michelle K. Lee

Michelle K. Lee
*Deputy Director of the United States Patent and Trademark Office*